US008042554B2

(12) United States Patent
Dumler

(10) Patent No.: US 8,042,554 B2
(45) Date of Patent: Oct. 25, 2011

(54) APPLICATOR ESPECIALLY FOR MASCARA

(75) Inventor: Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 158 days.

(21) Appl. No.: 11/501,116

(22) Filed: Aug. 9, 2006

(65) Prior Publication Data

US 2007/0033760 A1 Feb. 15, 2007

(30) Foreign Application Priority Data

Aug. 11, 2005 (EP) ..... 05017440

(51) Int. Cl.
*A45D 40/26* (2006.01)

(52) U.S. Cl. ..... 132/218; 15/187

(58) Field of Classification Search ..... 132/218, 132/317, 318, 320; 15/187
See application file for complete search history.

(56) References Cited

U.S. PATENT DOCUMENTS

| | | | | |
|---|---|---|---|---|
| 5,794,632 | A * | 8/1998 | Gueret | 132/317 |
| 6,260,558 | B1 | 7/2001 | Neuner | |
| 2002/0059942 | A1 * | 5/2002 | Neuner et al. | 132/218 |
| 2005/0034740 | A1 * | 2/2005 | Eckers et al. | 132/218 |
| 2006/0042647 | A1 * | 3/2006 | Vogel | 132/218 |

FOREIGN PATENT DOCUMENTS

| | | | |
|---|---|---|---|
| DE | 25 59 273 | A1 | 7/1977 |
| WO | WO 02/056726 | A | 7/2002 |

* cited by examiner

*Primary Examiner* — Rachel Steitz
(74) *Attorney, Agent, or Firm* — Browdy and Neimark, PLLC

(57) ABSTRACT

In an applicator, especially for mascara, hair dye, or similar cosmetics, including an oblong main body connectable to a rod. The main body is made of a comparatively hard synthetic material. A tubular bristle body having bristle-like, radially outwardly projecting extensions made of a relatively soft synthetic material, is also included. In order to attain an advantageous producibility and sturdy handling properties, the bristle body is axially fixed relative to the main body.

9 Claims, 4 Drawing Sheets

APPLICATOR ESPECIALLY FOR MASCARA

BACKGROUND OF THE INVENTION

1. Field of the Invention

The invention relates to an applicator, especially for mascara, hair dye, or similar cosmetics, comprising an oblong main body that is connectable to a rod, said main body being made of a comparatively hard synthetic material, also a tubular bristle body having bristle-like, radially outwardly projecting extensions made of a relatively soft synthetic material.

The principal advantage of an applicator of this type lies in that it can be manufactured cost-effectively. The relatively hard synthetic material of the main body imparts the required stability, whereas the soft synthetic material of the bristle body permits the formation of correspondingly soft bristle-like extensions.

2. Background Art

An applicator of this type is known from EP 0 038 524 A 1 and DE 25 59 273 A1, or from WO 02/056 726 A.

SUMMARY OF THE INVENTION

The invention is based on the object of further improving an applicator of this type in such a way that it provides for an advantageous producibility while exhibiting advantageous application properties.

To meet this object, provision is made for the bristle body to be axially fixed relative to the main body in such a way that the main body has formed on it, at the free distal end, a fixation cap overlapping the bristle body.

With an axial fixation of this kind it is achieved that, during handling, especially also during withdrawing and inserting of the applicator into a reservoir, e.g., in the case of a mascara unit, the position of the bristle body remains stable during passage through a wiper means.

In a further development of the invention, provision is made for the main body to have an annular bead that engages into a corresponding annular groove of the bristle body, thus producing the axial fixation. Within the framework of the invention, provision may also be made in a converse approach for the annular groove to be formed on the main body.

This fixation cap may advantageously have a rod extension that engages into a cavity of the main body, said rod extension being provided especially with an annular bead that is snappable into a annular groove in the cavity of the main body.

In another embodiment, the free distal end of the main body has a radially projecting fixation cap injection-molded in one piece therewith, whose out-side diameter, after thermal shaping with a stamp, approximately corresponds to the outside diameter of the bristle body, and which axially fixes the bristle body that may be attached by injection-molding in a 2-compound injection-molding process, or slipped on.

In a third embodiment, provision is made for the bristle body to have, in the region of the free distal end, a face wall resting against the face wall of the main body.

Furthermore, to provide for the axial fixation of the bristle body, provision may be made for the bristle body to be axially fixed relative to the main body in such a way that the rod extension has a conical cavity, the bristle body is provided with a gripper-like inner end, and when the rod extension is slipped on, the gripper arms of the gripper extension that are located at the end are pressed into a cavity of the main body.

The invention will be explained in more detail below based on preferred example embodiments in conjunction with the drawing.

DESCRIPTION OF THE PREFERRED EMBODIMENTS

Figure 1:
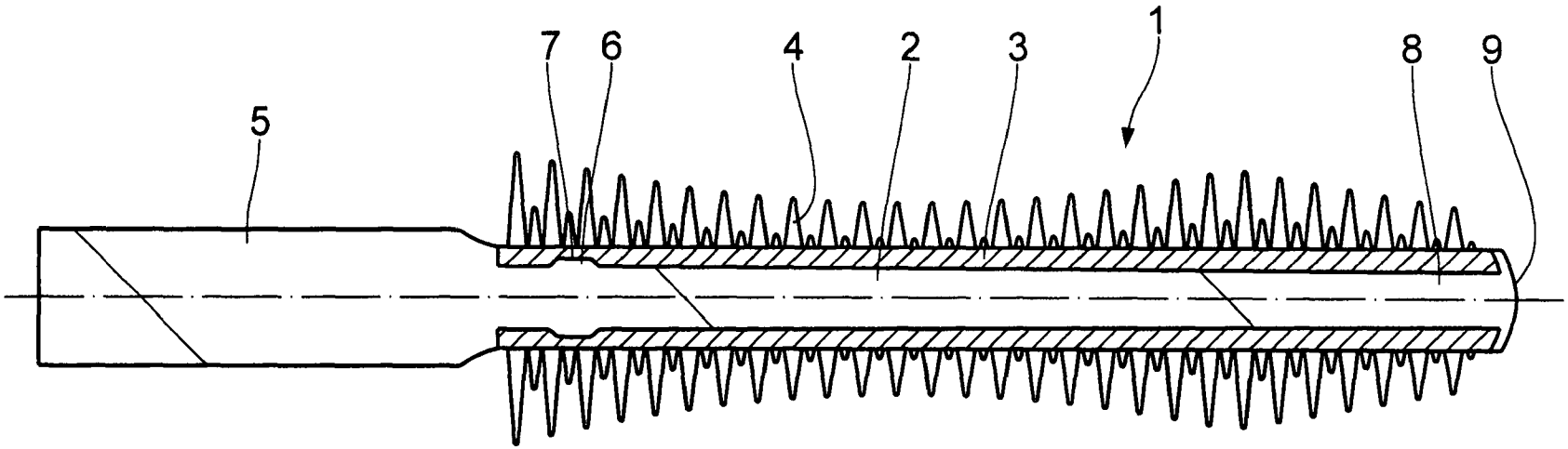
FIG. 1 shows a longitudinal section through a first embodiment of an inventive applicator.

An applicator 1 shown in the drawing comprises a main body 2 made of a relatively hard material and comparatively hard synthetic material, and a bristle body 3 made of a relatively soft synthetic material having injection-molded to it radially outwardly extending bristle-like extensions 4. The main body 2 is injection molded in one piece with a rod extension 5 that is connectable to a rod.

The rod may be connected in a manner known per se to the inside of the cover of a screw cap, which, in turn, is screwed onto the external thread of a reservoir for the given cosmetic product, e.g., mascara.

For fixing the bristle body 3 in an axial direction relative to the main body 2, especially during passage through a wiper means, the main body 2 has an annular bead 6 that engages into a corresponding circumferential groove 7 on the bristle body 3. An additional fixation is provided such that on the distal end 8 of the main body 2 a fixation cap 9 is provided, whose outside diameter approximately corresponds to the outside diameter of the bristle body 3.

Figure 2:
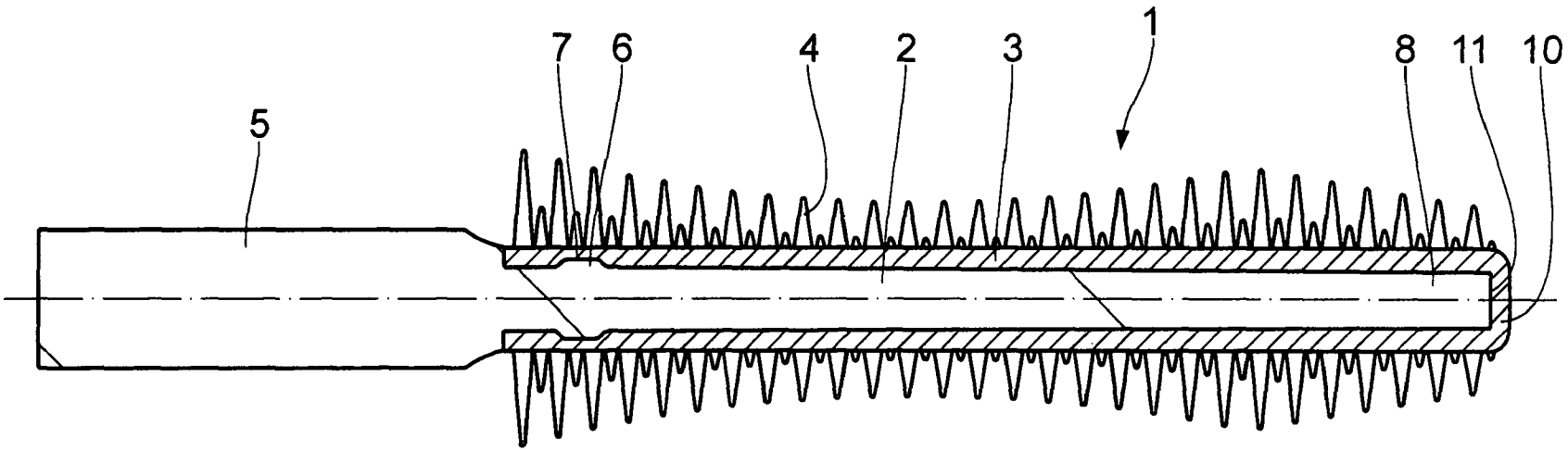
FIG. 2 shows a longitudinal section through a second embodiment.

The embodiment shown in FIG. 2, which is essentially made out like the embodiment of FIG. 1, has provided on it, in lieu of the fixation cap 9, a face wall 10 that is injection-molded integrally with the bristle body 3, said face wall 10 resting against the front face 11 at the distal end 8 of the main body 2.

Figure 3:
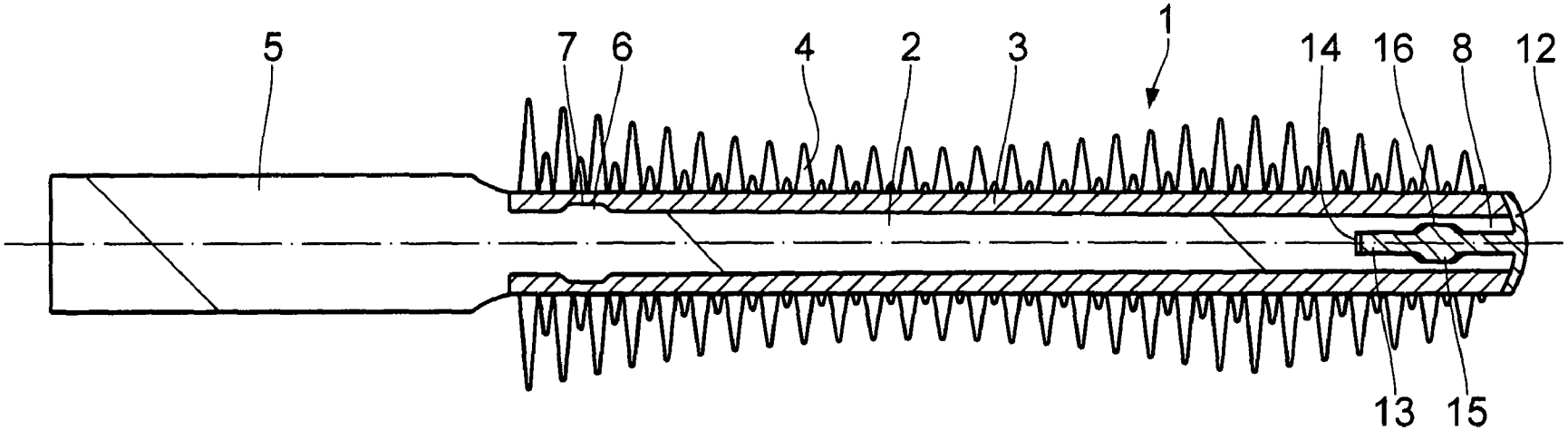
FIG. 3 shows a longitudinal section through a third embodiment.

The embodiment according to FIG. 3, in turn, has provided at the distal end 8 of the main body 2 a fixation cap 12 corresponding to the fixation cap 9 of the embodiment example in FIG. 1, which, however, is not formed integrally with the main body 2, but instead has a rod extension 13 that engages into a cavity 14 in the main body 2 and is fixed there by means of an annular bead 15 and a corresponding annular groove 16 on the interior wall of the cavity 14.

Figure 4:
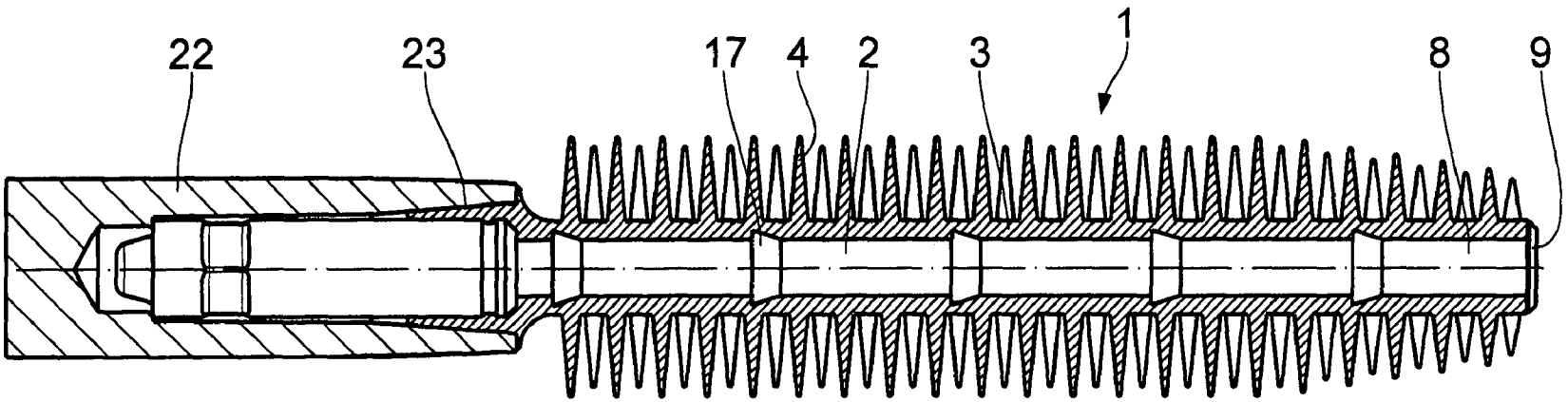
FIG. 4 shows a longitudinal section through a fourth embodiment.

In the embodiment of FIG. 4, the main body 2 has a plurality of collar-like projections 17 that have a frusto-conical shape such that the truncated cone tapers toward the free end. When the bristle body 3 is mounted on the main body 2 correspondingly, the projections 17 act like barbs and prevent the bristle body 3 from becoming detached.

Figure 5:
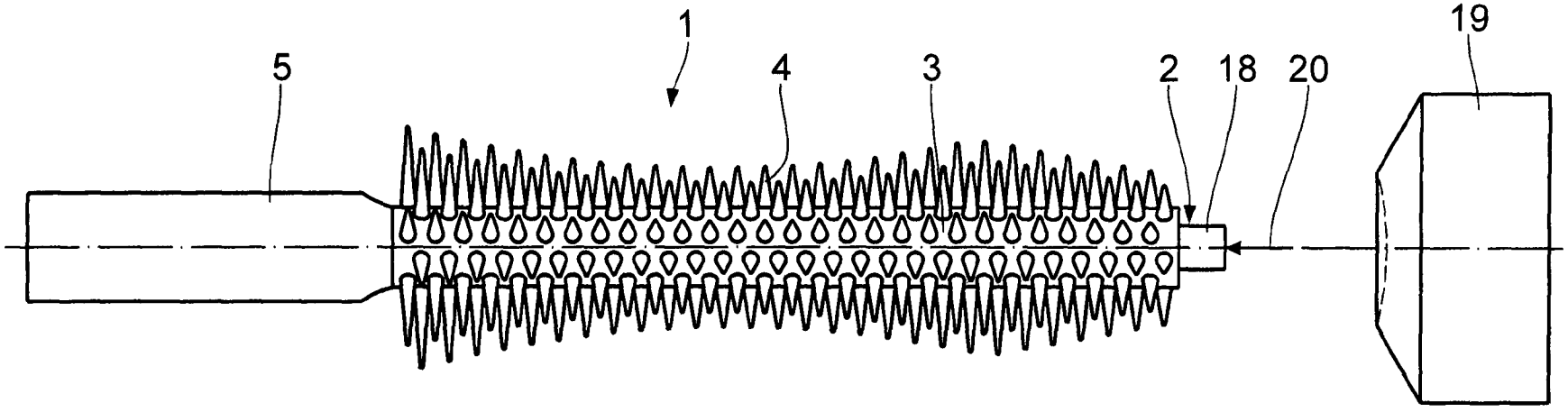
FIG. 5 shows a longitudinal section illustrating one possibility for implementing the embodiment of FIG. 1.

In accordance with FIG. 5, provision is made for the main body 2 to be dimensioned such that a free outer end 18 projects beyond the bristle body 3. By pressing-on a heated stamp 19 in the direction of the arrow 20, this free end 18 is then deformed in such a way that a fixation cap is created, as it is shown in FIG. 1.

Figure 6:
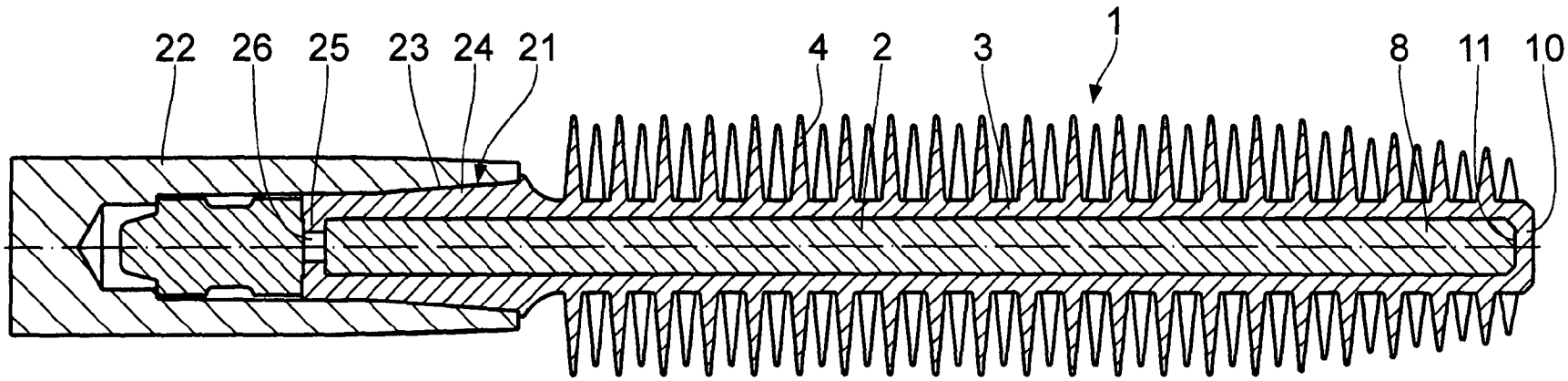
FIG. 6 shows a longitudinal section of an embodiment according to FIG. 2 concerning the fixation of the brush on the rod.

In the embodiment according to FIG. 6, the bristle body 3 has a gripper-like inner end 21. A rod extension 22 is provided with a conical cavity 23. When the rod extension 22 is slipped on, the conical opening 23 overlaps the likewise conical region 24 of the gripper extension 21, so that gripper arms 25 at the end are pressed into a bore 26 of the main body 2, and a sturdy connection is created in this manner.

Figure 7:
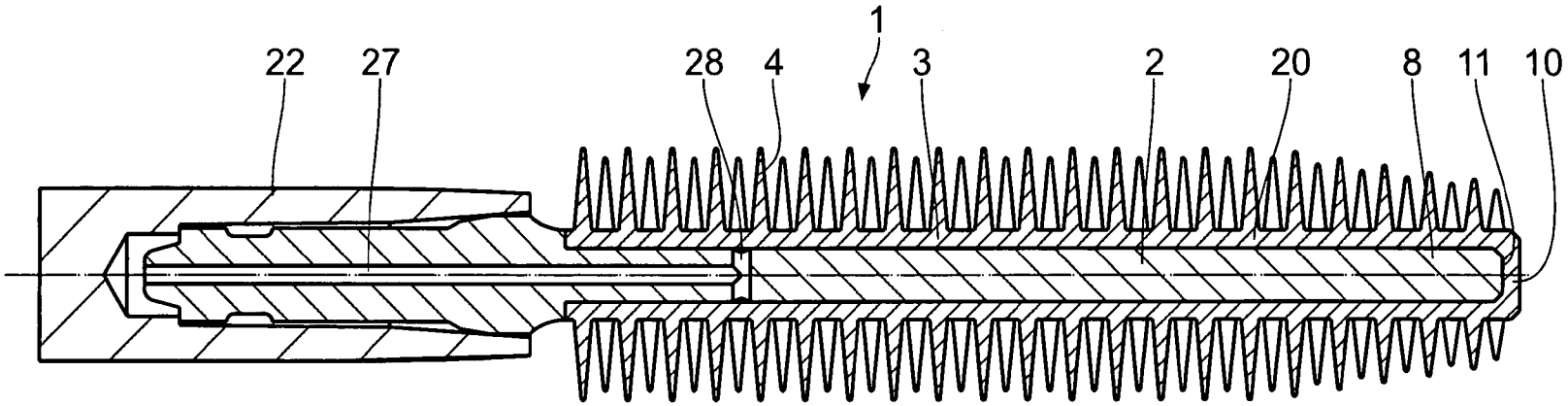
FIG. 7 shows a longitudinal section according to FIG. 6 concerning an additional fastening variant.

In the embodiment according to FIG. 7, the main body 2 has a longitudinally extending groove 27 that opens into a radial bore 28. Via the groove 27 glue can be squeezed in, which exits via the radial bore 28 and reliably connects the bristle body 3 to the main body 2.

Figure 8:
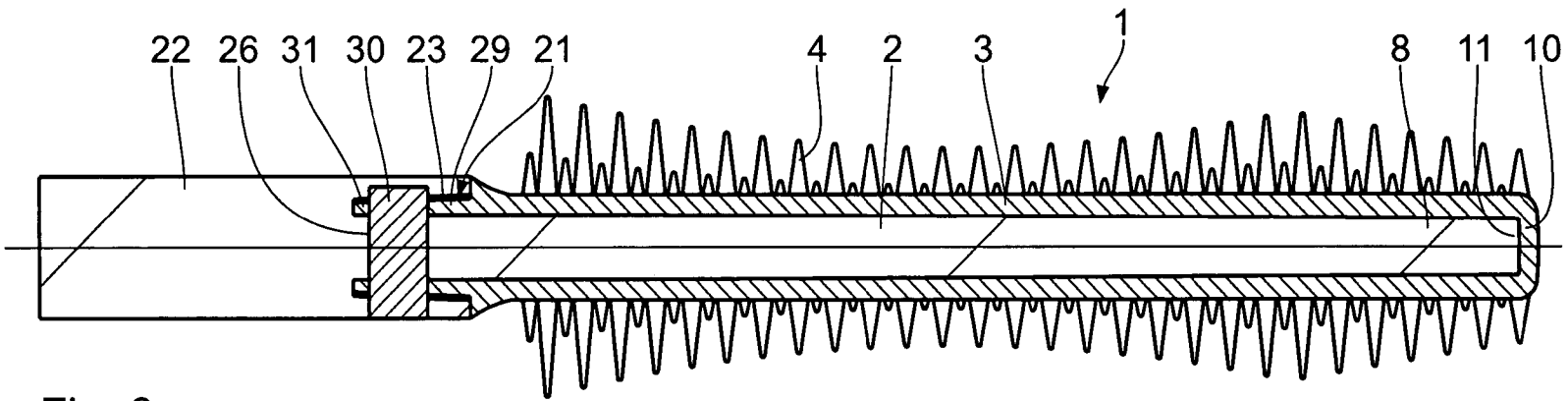
FIG. 8 shows a longitudinal section according to the embodiment of FIG. 2, to illustrate a third fastening variant.

Presented in FIG. 8 is an embodiment wherein the main body 2 is formed in one piece with a rod extension 22, which, in accordance with FIG. 6, has a conical cavity 23 implemented in the form of an annular groove, into which the likewise conical end 29 of the bristle body engages and is locked in place by means of a radial pin 30. The inner end 31 of the bristle body 3 transitions conically aligned into the rod extension 22.

As a result of this design, the wiper is prevented from getting caught in the transition region during the wiping process. The result is that the bending-slack bristle body 3 does not get pulled off the stiff main body 2.

As is apparent especially from FIG. 4, the cavity in the mounting extension 22 may be dimensioned relative to the rod extension of the main body 2 such that an annular groove is created, in which an extension of the bristle body 3 is received.

The bristle body 2 may also have two extensions that extend at a distance from each other and have inwardly projecting pins at their ends. When the rod extension 22 is then slipped on, the extensions are pushed inward gripper-like by the interior wall of the conical cavity 23 of the rod extension 22 and then engage into corresponding cavities of the main body 2, so as to become fixed.

The rod extension 2 may be implemented polygonal, e.g., pentagonal, in order to thus render it non-rotating.

The bristles are preferably conical, as drawn in the example embodiment, but they may also be round and have only a conical or chisel-shaped tip.

The cross-section of the bristles may be round or also deviate from a round geometry. The number of bristles may be between 30 and 600. The bristles may form a comb in the axial direction.

What is claimed is:

1. An applicator for cosmetics, comprising:

an oblong main body having a free distal end and a proximal end, said proximal end connected to a first end of a rod extension, said rod extension having a second end connectable to a rod, said main body being formed in one piece with said rod extension and being made of a comparatively hard synthetic material to provide stability to the applicator, a tubular bristle body having injection-molded, bristle-shape, radially, and outwardly projecting extensions, said tubular bristle body and said projecting extensions being made of a relatively soft synthetic material, wherein said main body has a diameter that is thinner than a diameter of said rod extension, and comprises a solid, uninterrupted fixation cap formed on a distal end of said main body, wherein the bristle body is a single bristle body and is seated in a recess formed between the rod extension and the fixation cap, said fixation cap having an outside diameter approximately corresponding to an outside diameter of the bristle body and said fixation cap overlapping said bristle body, and wherein said bristle body comprises an annular groove on an inner surface thereof, and the main body has an annular bead extending around an entire circumference of said main body and engaging into said annular groove of the bristle body which, in cooperation with said fixation cap, axially fixes said bristle body relative to said main body.

2. An applicator according to claim 1, wherein the fixation cap (12) has a first rod extension (13) engaging into a cavity (14) of the main body (2).

3. An applicator according to claim 2, wherein the first rod extension (13) has an annular bead (15) that is snappable into an annular groove (16) in the cavity (14) of the main body (2).

4. An applicator according to claim 1, wherein the main body and the fixation cap are injection-molded in one piece with the rod.

5. An applicator according to claim 1, wherein the fixation cap is a radially projecting fixation cap formed in one piece with the main body.

6. An applicator according to claim 5, wherein the radially projecting fixation cap is formed by pressing a heated stamp on the free distal end of the main body.

7. An applicator according to claim 5, the radially projecting fixation cap is injection-molded in one piece with the free distal end of the main body.

8. An applicator according to claim 1, wherein the main body (2) has a plurality of collar projections (17).

9. An applicator according to claim 8, wherein the collar projections (17) have a frusto-conical shape such that the truncated cone tapers toward the free distal end (8).

* * * * *